US005401098A

United States Patent [19]

Vadnais

[11] Patent Number: 5,401,098

[45] Date of Patent: Mar. 28, 1995

[54] PORTABLE HAND-HELD CONCRETE AND MORTAR MIXER

[76] Inventor: Kenneth Vadnais, 28995 Sunnyvale, Livonia, Mich. 48154

[21] Appl. No.: 147,978

[22] Filed: Nov. 5, 1993

[51] Int. Cl.[6] ..... B28C 5/08

[52] U.S. Cl. ..... 366/64; 172/42; 172/60; 366/293; 416/195

[58] Field of Search ..... 366/64, 65, 66, 1, 129, 366/130, 293, 279; 416/195; 172/557, 604, 42, 57, 60, 119, 123

[56] References Cited

U.S. PATENT DOCUMENTS

| | | | |
|---|---|---|---|
| 994,978 | 6/1911 | Clemens . | |
| 1,593,706 | 7/1926 | Skoog | 366/65 |
| 3,031,018 | 4/1962 | Smithers | 172/42 |
| 3,166,303 | 1/1965 | Chapman | 259/135 |
| 3,185,451 | 5/1965 | Snyder | 259/179 |
| 4,074,764 | 2/1978 | Enters | 172/42 |
| 4,256,183 | 3/1981 | Hanley | 172/123 |
| 4,761,076 | 8/1988 | Witcombe | 366/46 |

*Primary Examiner*—Robert W. Jenkins
*Attorney, Agent, or Firm*—James M. Deimen

[57] ABSTRACT

A portable hand-held concrete, mortar and gypsum mixer comprises a small gasoline powered implement having a drive shaft extending generally downward from the handles to a gear box. A transverse shaft driven by the drive shaft extends to either side of the gear box. Mounted on the transverse shaft are a plurality of blades shaped to thoroughly agitate and mix a combination of water and the ingredients for concrete, mortar, gypsum or similar heavy, hard to mix materials. Surrounding the blades are thin rings attached to the blades to form a round circumferential surface about the blades and thereby prevent the blades from directly contacting the mixing trough or other means of containing the mix. In the alternative, the plurality of blades may be shaped at their peripheries to form substantially continuous circular circumferences.

7 Claims, 1 Drawing Sheet

PORTABLE HAND-HELD CONCRETE AND MORTAR MIXER

BACKGROUND OF THE INVENTION

The field of the invention pertains to light-weight portable mixers and, in particular, to hand-held powered mixers for thick heavy viscous liquids which may contain solids.

Typically, concrete, cement mortar, gypsum and other similar construction materials are mixed in stationary, truck or trailer mounted rotary bowls. The bowls are equipped with curved fins inside to assist in thoroughly mixing water with the powder and aggregates. Even the smallest bowl mixers are too heavy for one person to easily lift because of the weight of the steel bowl and attached motor. When a relatively small amount is needed these construction materials are typically hand mixed with a perforated hoe in a metal trough.

Despite the need for a truly portable powered hand-held mixer, apparently none are commercially available. An early apparently portable mixer is disclosed in U.S. Pat. No. 994,978. This mixer has an externally driven shaft with a plurality of curved mixing blades thereon. The material is mixed as the blades move the material parallel to the shaft to the outlet.

U.S. Pat. No. 3,166,303 discloses a plurality of blades on a vertical shaft as the mixing device. The shaft is powered by a portable electric drill and a vertical barrel is used to contain the mix. U.S. Pat. No. 3,185,451 also discloses an electric powered hand-held mixer having a pair of counter-rotating spiral wire blades. The mixer is used in a large mixing trough.

U.S. Pat. No. 4,761,076 and an advertising brochure from Sears, Roebuck & Co., Chicago, Ill. disclose a wheeled mixing tub equipped with an auger mixer. The auger is gasoline powered and mounted permanently to the tub in a manner that permits the auger to be moved from one side of the tub to the other. Thus, the mixer is not truly portable in the manner of a hand-held mixing device.

SUMMARY OF THE INVENTION

It is an object of the invention to provide a sufficiently powerful hand-held mixer than can quickly and efficiently mix concrete, mortar and gypsum in small quantities.

It is a further object of the invention to provide a mixer that is as light, portable and simple to operate as other common power tools and power yard implements intended for the home handy-man or woman.

The new mixer is based upon a small hand-held gasoline powered garden tiller such as the Ryobi Cultivator Model 410r from Ryobi Outdoor Products, Inc., Chandler, Ariz. The blade assembly is modified by adding circular steel rings having a diameter slightly greater than the maximum diameter swept by the tiller blades. The steel rings are formed of rod and brazed or welded to the tips of the tiller blades. Additional steel rod spokes attach the rings to the blade hubs. The rings permit the hand-held tiller to be operated in a mixing trough without damage to the trough or the blades of the tiller.

The mixer is particularly effective and convenient. The prototype mixer weighs about twenty-five pounds and mixes thoroughly a one-hundred pound bag of ready-mix concrete or mortar with water in less than three minutes.

DESCRIPTION OF THE PREFERRED EMBODIMENT

Figure 1:
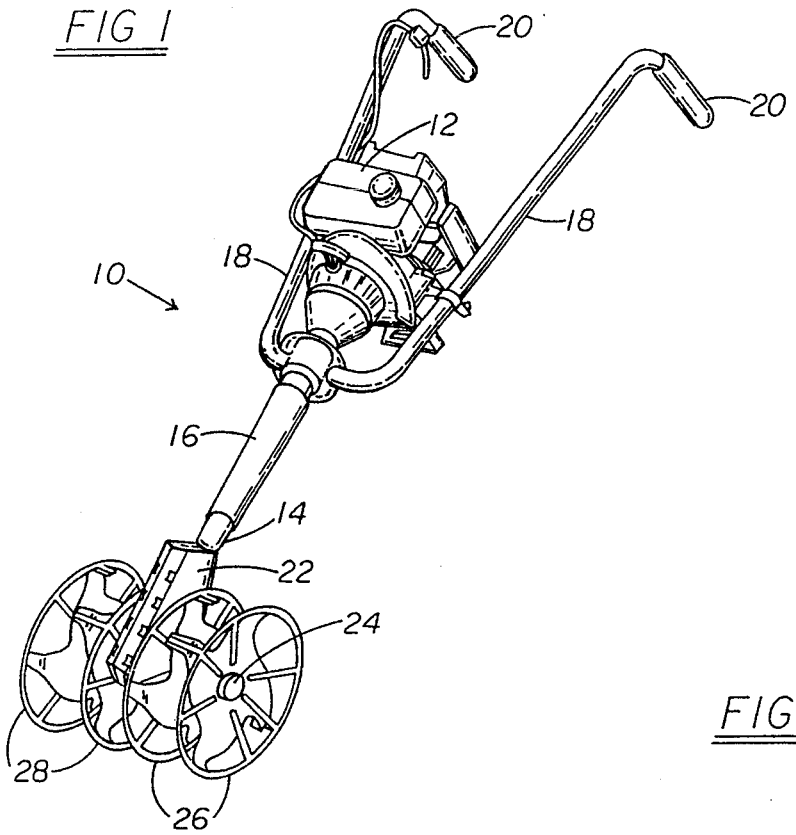
FIG. 1 is a perspective view of the new mixer.

Illustrated in FIG. 1 is a small hand-held tiller generally denoted by 10 that is modified into a mixer. The tiller 10 includes a small gasoline engine 12 mounted on a drive shaft housing 14 that in turn is covered with a hand grip 16. Attached to the drive shaft housing 14 is a pair of handles 18 also with hand grips 20. At the lower end of the drive shaft housing 14 is a gear box 22. Located within the drive shaft housing 14 is a drive shaft connected to the engine 12 and extending into the gear box 22. Extending horizontally from the gear box 22 is a shaft 24 upon which are mounted two pairs of blade assemblies 26 and 28 to either side of the gear box 22.

Figure 2:
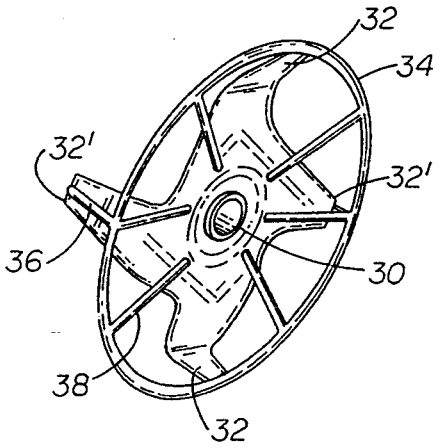
FIG. 2 is a close-up perspective view of one of the blade assemblies for the mixer.

Referring to FIG. 2 each blade assembly 26 or 28 comprises a disc and hub 30 for mounting on the shaft 24 and four tines 32 and 32' that are bent over from the disc in the same manner as tiller tines. A steel ring 34 is welded or brazed to the tips of the two diametrically opposite tines 32 that extend in the same direction. The two alternating diametrically opposite tines 32' extend in the opposite direction and are connected to the ring 34 by short transverse pieces 36 of rod welded therebetween. In addition, a plurality of short radial rods 38 extend from the disc and hub 30 area to the ring 34 to form spokes welded or brazed therebetween. The entire blade assembly forms a rigid "cage" that both protects the tines 32 from impact with the container of the material to be mixed and assists in mixing the material.

Figure 3:
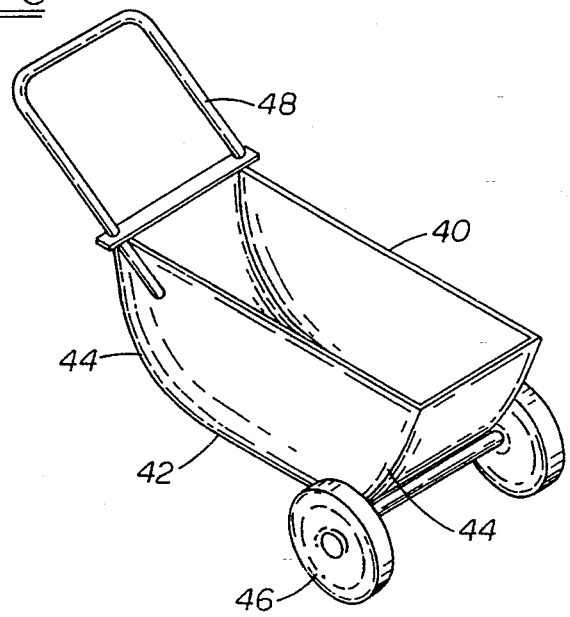
FIG. 3 is a perspective of a small separate mixing trough that is particularly effective with the mixer.

Although the new mixer may be used with any large conventional concrete and mortar hand mixing trough or container of sufficient size, a particularly convenient mixing trough 40 is shown in FIG. 3. The trough is sized to a width about one inch greater than the full blade width of the new mixer. The trough is also about three feet long and one foot deep. The bottom 42 of the trough 40 is curved upward at the ends 44 to eliminate bottom corners that otherwise would collect unmixed or ineffectively mixed material. The trough 40 also includes a set of wheels 46 at one end and a handle 48 at the other end. A single eighty or one-hundred pound bag of ready-mix concrete or mortar can be quickly mixed with water using the mixer. The trough 40 can then be easily wheeled to the desired location and dumped by raising the handle.

Cleaning of the mixer and trough are also greatly simplified in comparison with conventional concrete and mortar mixers. The trough is merely filled with fresh water and the mixer operated in the water in the trough. The vigorous mixing action quickly and effectively cleans both mixer and trough.

As alternative forms of the mixer an electric motor may be substituted for the small gasoline engine. The blades may also be modified in shape to have external peripheries substantially circular in circumference. The substantially circular peripheries protect the blades and container from impact damage in substitution for the rings.

I claim:

1. A portable hand-held mixer comprising handle means adapted to support the mixer in a generally upright position, an engine attached to the handle means, drive means extending generally downwardly from the engine, a lower end on the drive means, a transverse shaft in driven engagement with the drive means at the lower end and extending outwardly from the lower end, a plurality of mixing blades mounted on the transverse shaft, and at least one of the mixing blades having a periphery forming substantially a full circle, all portions of said mixing blade limited radially and outwardly transversely by the substantially circular periphery.

2. The mixer of claim 1 wherein at least one of the mixing blades has a plurality of tines extending to the periphery of the blade, and the blade includes a rod attached to the peripheral tips of the tines and forming the circular periphery about the blade.

3. The mixer of claim 1 wherein at least one of the mixing blades includes a peripheral rod attached to the blade and forming the circular periphery about the blade.

4. The mixer of claim 3 including a plurality of radial spoke rods attached to the peripheral rod and extending generally radially inwardly to attachments with an inner portion of the blades.

5. The mixer of claim 4 wherein the blade includes a plurality of tines extending to the periphery of the blade and at least one tine is attached to the peripheral rod by a transverse rod therebetween.

6. The mixer of claim 3 wherein the blade includes a plurality of tines extending to the periphery of the blade and at least one tine is attached to the peripheral rod by a transverse rod therebetween.

7. The mixer of claim 1 wherein the transverse shaft extends from both sides of the lower end and at least one blade is positioned on the transverse shaft on each side of the lower end, each of said blades having a circular periphery.

* * * * *